US006402645B2

(12) United States Patent
Liao

(10) Patent No.: US 6,402,645 B2
(45) Date of Patent: Jun. 11, 2002

(54) SHOCK-ABSORBING DEVICE FOR USE IN GAME APPARATUS HAVING TUBULAR ROD BODY

(76) Inventor: Chi-Hua Liao, No. 282-1, Chung San Rd., Tein Hsin Li, Feng Yuan City, Taichung Hsien (TW)

( * ) Notice: Subject to any disclaimer, the term of this patent is extended or adjusted under 35 U.S.C. 154(b) by 0 days.

(21) Appl. No.: 09/850,109

(22) Filed: May 8, 2001

(30) Foreign Application Priority Data

May 11, 2000 (TW) ..... 89207892 U

(51) Int. Cl.[7] ..... A63B 49/06
(52) U.S. Cl. ..... 473/520; 473/523
(58) Field of Search ..... 473/520, 521, 473/523, 524, 546

(56) References Cited

U.S. PATENT DOCUMENTS 4,353,551 A * 10/1982 Arieh et al. ..... 473/521
4,948,131 A * 8/1990 Nakanishi ..... 473/521
5,865,694 A * 2/1999 Duong-Van ..... 473/520

FOREIGN PATENT DOCUMENTS

GB 2225537 * 6/1990 ..... 473/FOR 181
GB 2225539 * 6/1990 ..... 473/FOR 181

* cited by examiner

*Primary Examiner*—Raleigh W. Chiu
(74) *Attorney, Agent, or Firm*—Browdy and Neimark, P.L.L.C.

(57) ABSTRACT

A shock-absorbing device is designed for use in a game apparatus having a tubular rod body. The game apparatus comprises a ball-hitting portion, and a grip portion. The ball-hitting portion is formed of a frame, a ball-hitting face defined by the frame, and a neck extending from the frame. The grip portion is formed of a hollow rod and is fastened with the neck. The neck is provided with at least one groove and one shock-absorbing device which is disposed in the groove. The groove is extended along the longitudinal direction of the neck and toward the grip portion. The shock-absorbing device is formed of an absorbing member and a weight body which is put through the absorbing member and is capable of swiveling upon being exerted on by an external force.

7 Claims, 5 Drawing Sheets

SHOCK-ABSORBING DEVICE FOR USE IN GAME APPARATUS HAVING TUBULAR ROD BODY

FIELD OF THE INVENTION

The present invention relates generally to a game apparatus, and more particularly to a shock-absorbing device of the game apparatus with a tubular rod body.

BACKGROUND OF THE INVENTION

As shown in FIGS. 1 and 2, a prior art tennis racket 10 comprises a ball-hitting portion 11 and a grip portion 12. The ball-hitting portion 11 is formed of a frame 13 and a ball-hitting surface 14 defined by the frame 13. The grip portion 12 is fastened at one end with the ball-hitting portion 11 and is formed of a hollow rod 15 and a shock-absorbing device 16 which is disposed in the hollow rod 15 and is formed of a resilient body 17 and a weight 18. The resilient body 17 is made of a rubber or foam material and is provided at the center with a connection ring 191 and four connection portions 192. The weight 18 is disposed in the resilient body 17 such that the weight 18 is put through the connection ring 191 of the connection structure 19. The shock-absorbing effect is attained by the swiveling of the weight 18 in the resilient body 17.

The shock-absorbing device is disposed only in the rod body of the prior art tennis racket 10. The frame is not provided with the shock-absorbing device and is apt to sway upon being impacted on by a ball. In spite of the tennis racket being of a hollow design, the tennis racket is not provided with a space for mitigating the shock wave. In addition, the shock-absorbing device is concealed in the hollow rod body of the prior art tennis racket and can not be seen by the consumers who have a tendency to resist invisible things.

SUMMARY OF THE INVENTION

It is the primary objective of the present invention to provide a shock-absorbing device which is for use in a game apparatus having a tubular rod body and is capable of mitigating the shock wave in the frame to reduce the swiveling action of the frame.

It is another objective of the present invention to provide a shock-absorbing device which is designed for use in a game apparatus having a tubular rod body and is provided with a shock wave mitigating space to maximize the shock-absorbing effect.

It is still another objective of the present invention to provide a shock-absorbing device which is intended for use in a game apparatus having a tubular rod body and is visible to the user of the game apparatus. The visibility of the shock absorbing device is the style and the feature of the product.

The shock-absorbing device of the present invention is disposed on a game apparatus which comprises a ball-hitting portion and a grip portion. The ball-hitting portion includes a frame, a ball-hitting surface defined by the frame, and a neck extending from the frame. The grip portion is fastened at one end with the neck and is formed of a hollow rod. The present invention is characterized by the neck which is provided with at least one groove of a length and extending in the direction toward the grip portion, and with at least one shock-absorbing device disposed in the groove. The shock-absorbing device is formed of an absorbing member of a soft material, and a weight. The weight is put through the absorbing member such that the weight is capable of being caused by an external force to swivel.

DETAILED DESCRIPTION OF THE INVENTION

Figure 1:
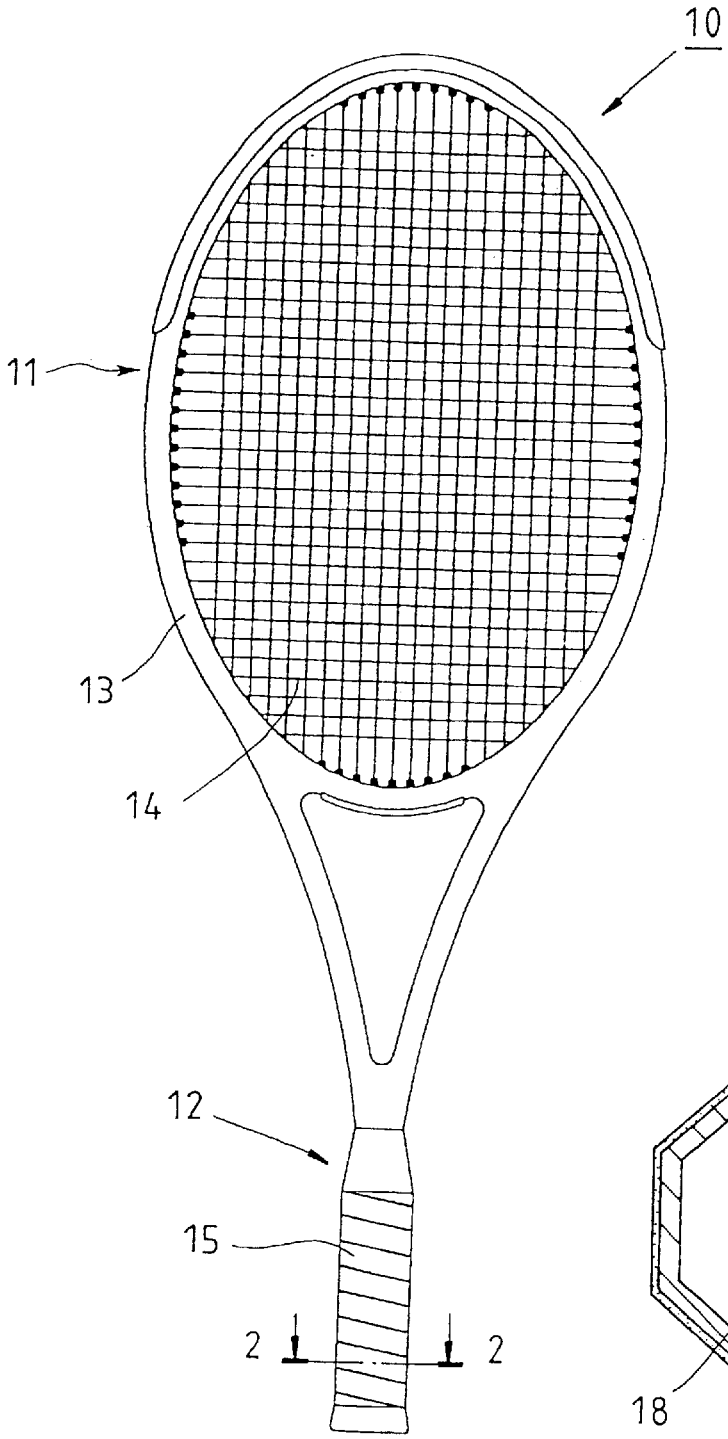
FIG. 1 PRIOR ART
FIG. 1 shows a perspective view of a tennis racket of the prior art.
Figure 2:
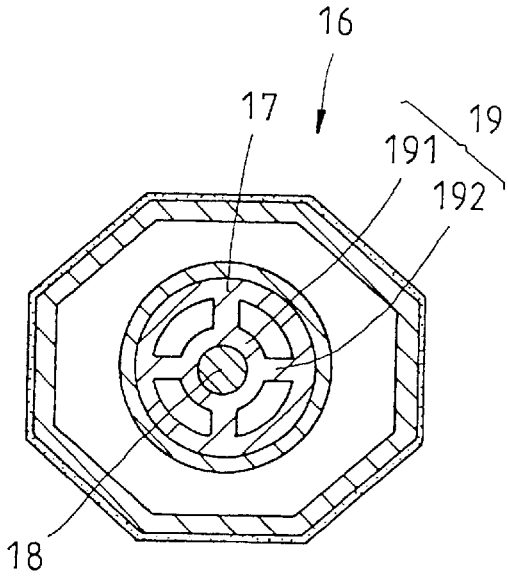
FIG. 2 PRIOR ART
FIG. 2 shows a sectional view of a portion taken along the line 2—2 as shown in FIG. 1.
Figure 3:
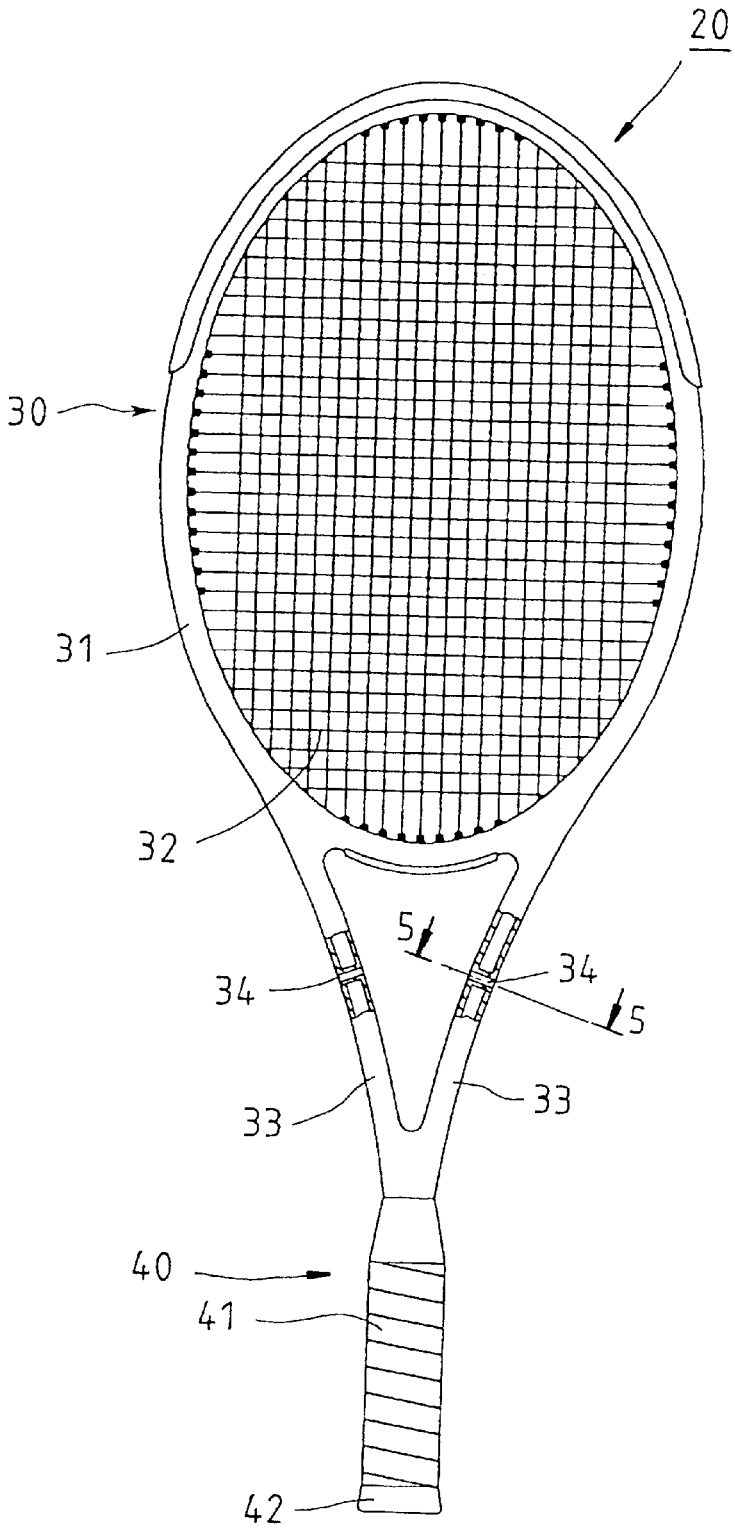
FIG. 3 shows a perspective view of the present invention in combination.
Figure 4:
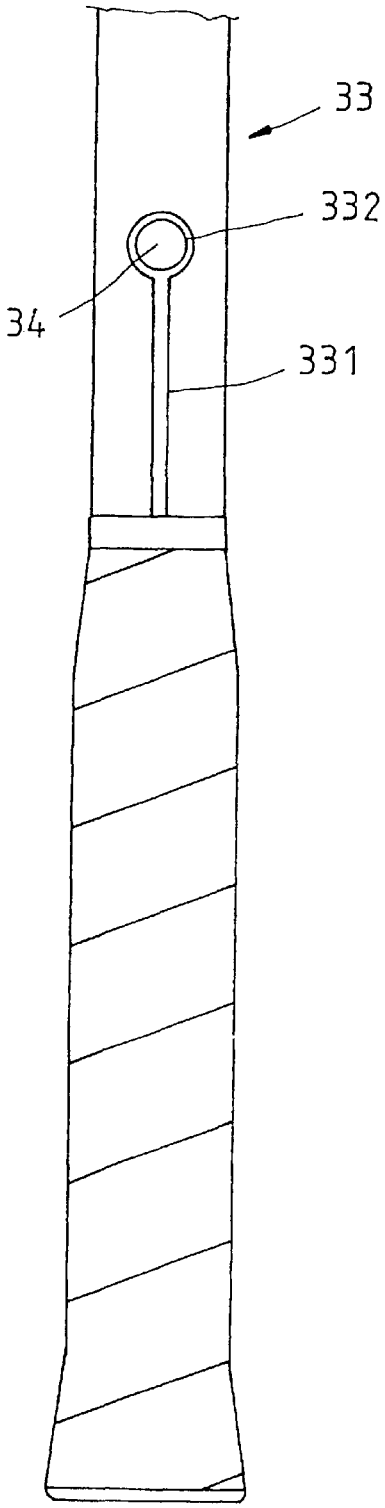
FIG. 4 shows a side view of a first preferred embodiment of the present invention.
Figure 5:
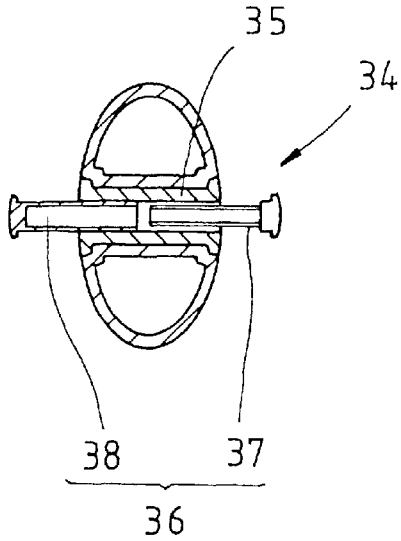
FIG. 5 shows a sectional view taken along the line 5—5 as shown in FIG. 3.

As shown in FIGS. 3–5, a shock-absorbing device of the present invention is disposed on a tennis racket 20 which comprises a ball-hitting portion 30 and a grip portion 40.

The ball-hitting portion 30 comprises a frame 31, a ball-hitting face 32 defined by the frame 31, a neck 33, and two shock-absorbing devices 34. The neck 33 is wider at one end which is extended from the bottom end of the frame 31. The neck 33 is provided in two longitudinal sides with a groove 331 of a length and extending in the direction toward the grip portion 40. The groove 331 is provided at one end with a receiving slot 332. The two shock-absorbing devices 34 are disposed in the receiving slots 332 of the two grooves 331 such that the shock-absorbing devices 34 are parallel to the ball-hitting face. The shock-absorbing devices 34 are formed of an absorbing member 35 of a soft material, and a weight body 36. The absorbing member 35 is made of a rubber material and is of a hollow cylindrical construction. The weight body 36 comprises a male screw 37 and a female nut 38. The screw 37 is put through the absorbing member 35 and is engaged with the nut 38.

The grip portion 40 is fastened with the ball-hitting portion 30 and is formed of a hollow lightweight rod 41 and a rear sleeve 42 fitted over the rod 41 for absorbing shock.

The shock wave is transmitted from the ball-hitting face of the ball-hitting portion 30 to the neck 33. In light of the elasticity of the absorbing member 35, the weight body 36 is capable of swiveling correspondingly along with the absorbing member 35. The swiveling frequency of the weight body 36 is different from the shock wave frequency. As a result, when the weight body 36 swivels, the shock wave is canceled out. In addition, the absorbing member 35 is inherently capable of absorbing the shock wave. The shock-absorbing device 34 has a dual shock-absorbing effect.

Figure 6:
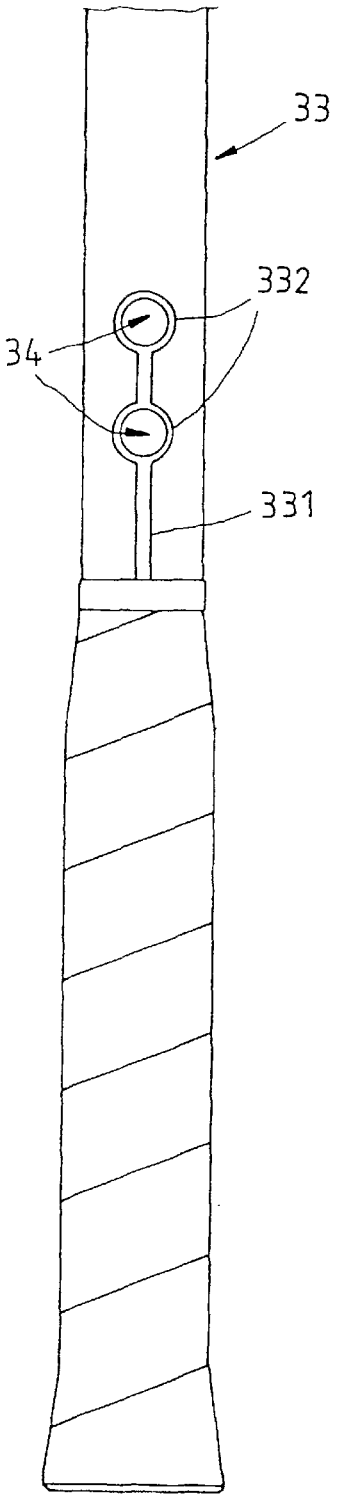
FIG. 6 shows a side view of a second preferred embodiment of the present invention.

As shown in FIG. 6, the second preferred embodiment of the present invention is different from the first preferred embodiment of the present invention in design in that the former comprises the neck 33 which is provided with two grooves 331, with each being provided with a plurality of shock-absorbing devices 34 which are arranged at intervals for providing a better shock-absorbing effect.

Figure 7:
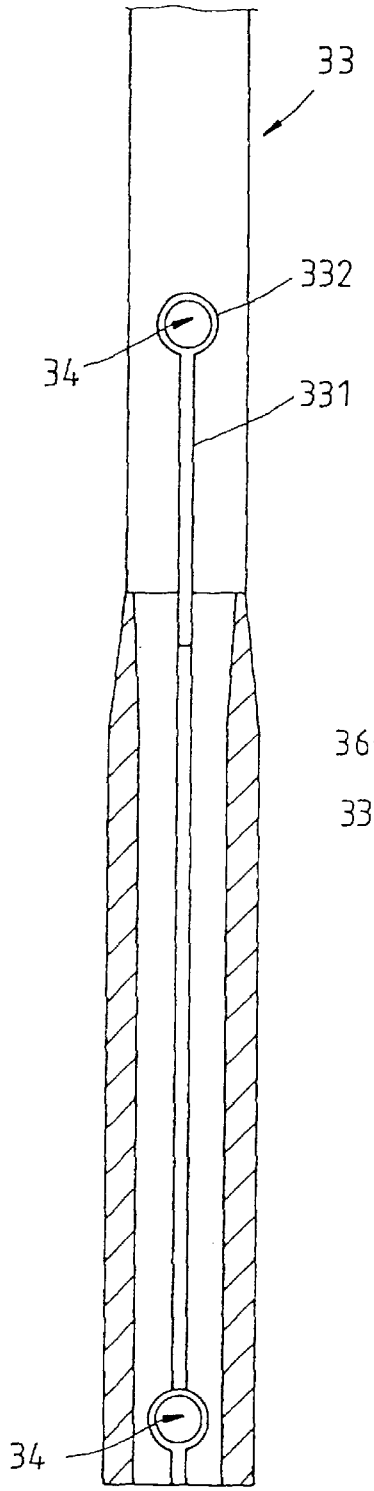
FIG. 7 shows a perspective view of a third preferred embodiment of the present invention.

As shown in FIG. 7, the third preferred embodiment of the present invention is different from the first preferred embodiment of the present invention in that the former comprises grooves 331 which are provided at the bottom end with one shock-absorbing device 34 for absorbing the shock wave traveling from the neck 33 toward the grip portion 40.

Figure 8:
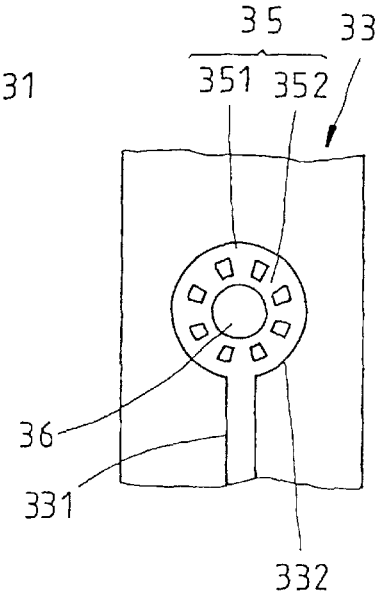
FIG. 8 shows a side view of a fourth preferred embodiment of the present invention.

As shown in FIG. 8, the fourth preferred embodiment of the present invention is different from the first preferred embodiment of the present invention in that the former comprises the absorbing member 35 which is provided at two ends with an outer ring 351. The outer ring 351 is provided in the inner wall with a plurality of columnar connection portions 352 which are arranged equidistantly. The weight body 36 is disposed in the connection portions 352 and is capable of a greater swiveling effect due to the connection portions 352.

Figure 9:
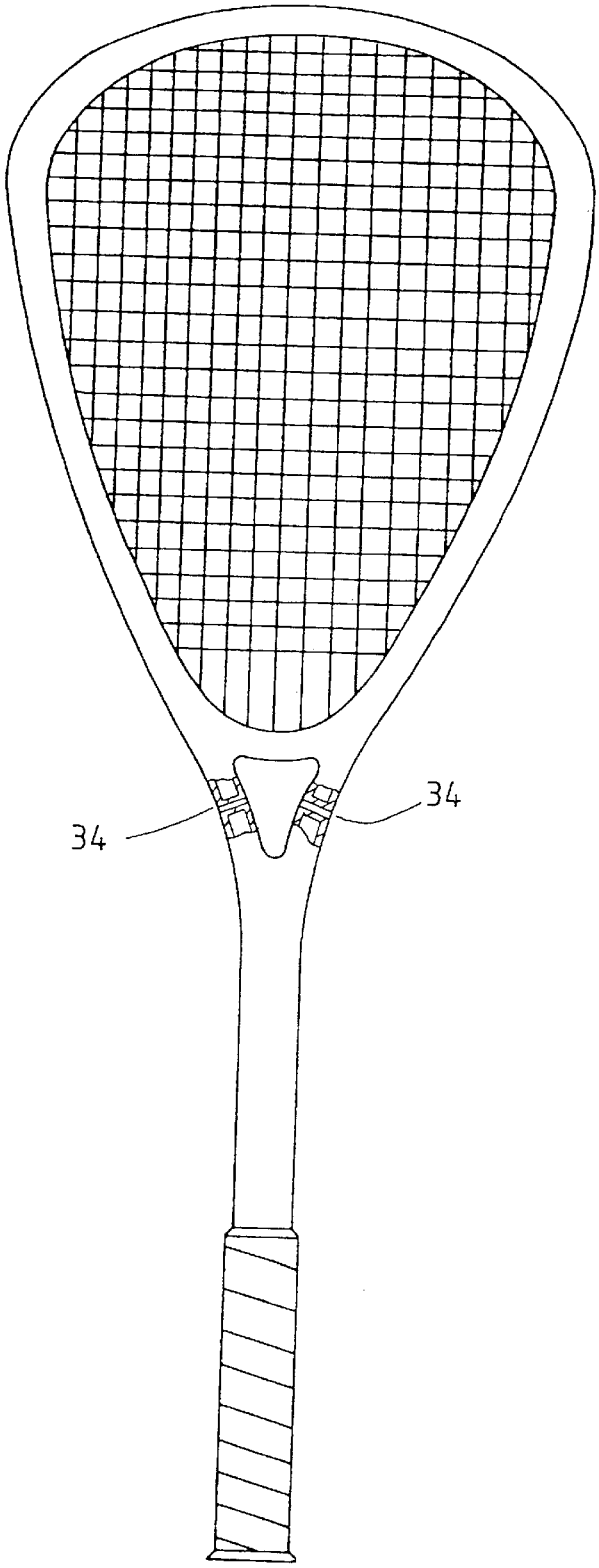
FIG. 9 shows a schematic view of the first preferred embodiment of the present invention which is disposed in a squash racket.

As shown in FIG. 9, the present invention can be also disposed in a squash racket.

In addition to the shock-absorbing effect, the present invention has a decorative effect which gives an added value to the game apparatus.

What is claimed is:

1. A game apparatus comprising:

a ball-hitting portion formed of a frame, a ball-hitting face defined by said frame, and a neck extending from said frame; and a grip portion fastened with said ball-hitting portion and formed of a rod;

wherein said neck is provided with at least one groove of a length and extending in the direction toward said grip portion, said neck further provided with at least one shock-absorbing device which is disposed in said groove and is formed of an absorbing member and a weight body, said weight body being put through said absorbing member such that said weight body is capable of swiveling at such time when said weight body is exerted on by an external force.

2. The game apparatus as defined in claim 1, wherein said groove is extended along the longitudinal direction of said neck toward said grip portion.

3. The game apparatus as defined in claim 1, wherein said weight body is formed of a male screw and a female nut, said male screw being put through said absorbing member such that said male screw is engaged with said female nut.

4. The game apparatus as defined in claim 1, wherein said groove is provided at one end with a receiving slot; wherein said shock-absorbing device is disposed in said receiving slot.

5. The game apparatus as defined in claim 1 wherein said groove is provided with a plurality of receiving slots; wherein said neck is provided with a plurality of shock-absorbing devices which are disposed in said receiving slots of said groove.

6. The game apparatus as defined in claim 1, wherein said groove is provided at two ends with a receiving slot; wherein said neck is provided with two shock-absorbing devices which are disposed in said two receiving slots of said two ends of said groove.

7. The game apparatus as defined in claim 1, wherein said absorbing member is provided at two ends with an outer ring which is provided in an inner wall with a plurality of connection portions of a columnar construction; wherein said weight body is disposed on said connection portions.

* * * * *